US008721012B2

(12) United States Patent
Chen et al.

(10) Patent No.: US 8,721,012 B2
(45) Date of Patent: May 13, 2014

(54) REINFORCEMENT AND ADJUSTMENT DEVICE FOR SLIDE ASSEMBLY

(75) Inventors: Ken-Ching Chen, Kaohsiung (TW); Chien-Li Huang, Kaohsiung (TW); Chun-Chiang Wang, Kaohsiung (TW)

(73) Assignee: King Slide Works Co., Ltd., Kaohsiung (TW)

( * ) Notice: Subject to any disclaimer, the term of this patent is extended or adjusted under 35 U.S.C. 154(b) by 318 days.

(21) Appl. No.: 13/220,966

(22) Filed: Aug. 30, 2011

(65) Prior Publication Data

US 2012/0087606 A1 Apr. 12, 2012

(30) Foreign Application Priority Data

Oct. 11, 2010 (TW) ..... 99134831 A

(51) Int. Cl.
*A47B 88/04* (2006.01)

(52) U.S. Cl.
USPC ..... 312/334.4; 211/26

(58) Field of Classification Search
USPC ..... 312/334.1, 334.4, 334.7, 334.8, 265.1; 211/26, 175, 183, 187, 190, 191; 248/200.1, 220.21, 220.22
See application file for complete search history.

(56) References Cited

U.S. PATENT DOCUMENTS

| | | | | |
|---|---|---|---|---|
| 6,230,903 | B1 * | 5/2001 | Abbott | 211/26 |
| 6,863,188 | B2 * | 3/2005 | Besserer et al. | 211/183 |
| 2001/0040142 | A1 * | 11/2001 | Haney | 211/183 |
| 2002/0074914 | A1 * | 6/2002 | Shih | 312/334.4 |
| 2003/0205539 | A1 * | 11/2003 | Lauchner et al. | 211/26 |
| 2004/0020874 | A1 * | 2/2004 | Haney | 211/26 |
| 2004/0217073 | A1 * | 11/2004 | Dobler et al. | 211/26 |
| 2006/0152115 | A1 | 7/2006 | Dubon et al. | |
| 2006/0157436 | A1 * | 7/2006 | Iwamoto | 211/191 |
| 2010/0282932 | A1 * | 11/2010 | Ong et al. | 248/206.5 |

* cited by examiner

*Primary Examiner* — James O Hansen
(74) *Attorney, Agent, or Firm* — Rosenberg, Klein & Lee

(57) ABSTRACT

A reinforcement and adjustment device includes a rail, a reinforcement member, an extension support and an installation support which is movably connected to the extension support. The rail has a top wall, a bottom wall and a sidewall connected between the top and bottom walls. The sidewall has a first face and a second face which is located opposite to the first face. A space between the top wall, the bottom wall and the first face of the sidewall define a slide path. The second face of the sidewall defines a recessed reinforcement path. The reinforcement member is movably located in the reinforcement path of the rail. The extension support is fixed to the reinforcement member and engaged with the rail. The rail is reinforced by the reinforcement member and the extension support. The installation support is adjustable by the cooperation of the extension support, the reinforcement member and the rail.

5 Claims, 4 Drawing Sheets

REINFORCEMENT AND ADJUSTMENT DEVICE FOR SLIDE ASSEMBLY

FIELD OF THE INVENTION

The present invention relates to a reinforcement and adjustment device, and more particularly, to a reinforcement and adjustment device for reinforcing the rails and providing function of adjustment to the rails of the slide assembly.

BACKGROUND OF THE INVENTION

U.S. 2006/0152115 to Dubon discloses an "Adjustable reinforcing bracket for telescoping slide rail assembly" and the slide rail assembly comprises a stationary slide rail 22 which has a wall with an outer surface and the two ends of the stationary slide rail are connected to two posts of a rack by two respective mounting elements 26, 40. The slide rail assembly comprises a reinforcing element 32 connected to the outer surface of the stationary slide rail and a mounting slide rail 34 is slidably connected to the reinforcing element.

However, the reinforcing element is fixed to the outer surface of the stationary slide rail and cannot be adjusted, so that only the specific portion of the stationary slide rail is reinforced. Besides, the mounting slide rail can only be adjusted relative to the reinforcing element to a limited length so that it cannot be used for the rack with posts separated by a longer distance.

The present invention intends to provide a reinforcement and adjustment device to improve the shortcomings of the existed embodiment.

SUMMARY OF THE INVENTION

The present invention relates to a reinforcement and adjustment device for a slide assembly and the device comprises a rail having a top wall, a bottom wall located corresponding to the top wall, and a sidewall connected between the top wall and the bottom wall. The sidewall has a first face and a second face which is located opposite to the first face. A space between the top wall, the bottom wall and the first face of the sidewall define a slide path. The second face of the sidewall defines a recessed reinforcement path. A reinforcement member is movably located in the reinforcement path of the rail. An extension support is fixed to the reinforcement member and has a first flange, a second flange located corresponding to the first flange, and a first connection portion connected between the first flange and the second flange. The first flange, the second flange and the first connection portion define an arm. The first flange and the second flange hold the top wall and the bottom wall. An installation support is movably connected to the extension support and an installation portion is connected to an end of the installation support.

Preferably, the reinforcement path is substantially parallel to the slide path.

Preferably, a top protrusion extends downward from the second face of the sidewall of the rail and reaches into the reinforcement path. A lower protrusion extends upward from the second face of the sidewall of the rail and reaches into the reinforcement path. The reinforcement member contacts the top and lower protrusions so as to hold a movement of the reinforcement member in the reinforcement path of the rail.

Preferably, the installation support has a first support portion, a second support portion located corresponding to the first support portion, and a second connection portion connected between the first support portion and the second support portion. The first support portion contacts the first flange and the second support portion contacts the second flange.

Preferably, the second connection portion of the installation support has two separated longitudinal slots and at least two positioning members which respectively extend the longitudinal slots and are connected to the extension support.

The primary object of the present invention is to provide a reinforcement and adjustment device for a slide assembly, the reinforcement member reinforces the rail and the attached parts on the rail provide the slide assembly with a telescoping feature.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
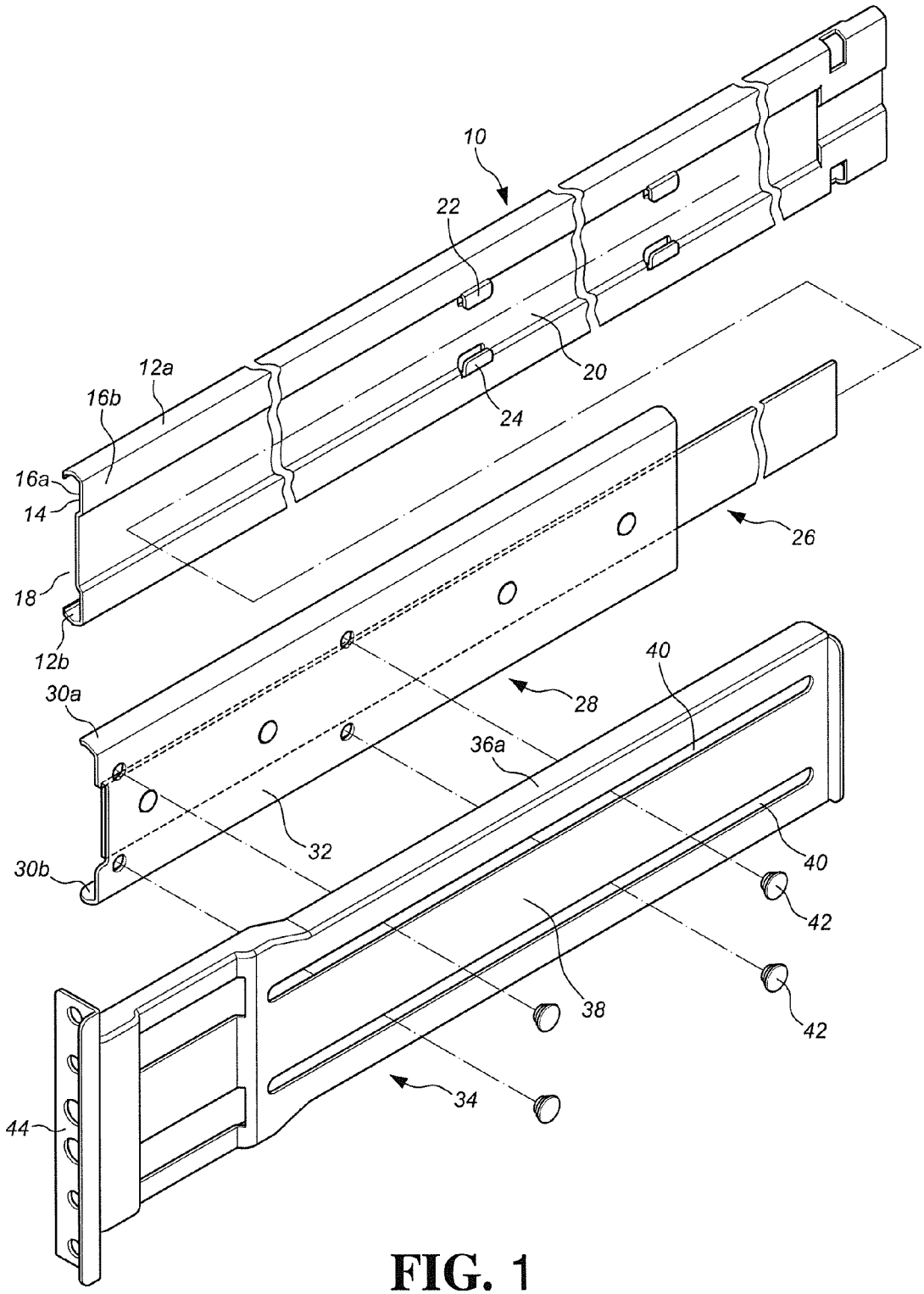
FIG. 1 is an exploded view to show the reinforcement device of the present invention.
Figure 2:
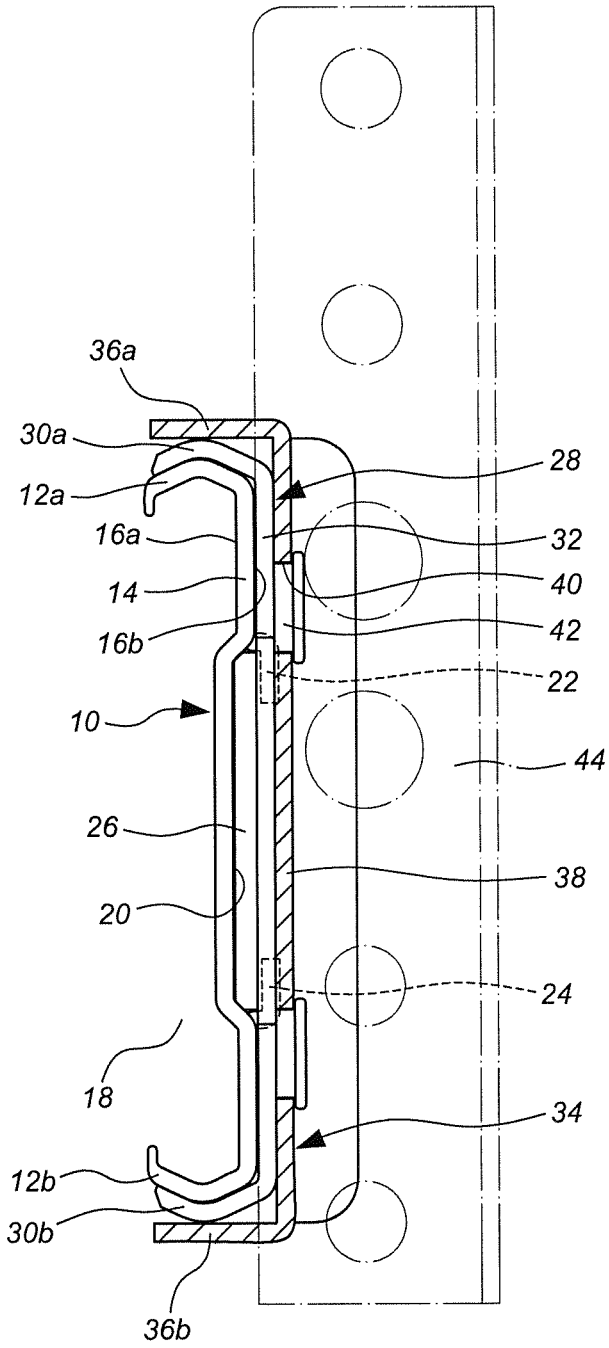
FIG. 2 is a cross sectional view to show that the reinforcement member, the extension support and the installation support are connected to the rail.

Referring to FIGS. 1 and 2, the reinforcement and adjustment device of the present invention comprises a rail 10 which comprises a top wall 12*a*, a bottom wall 12*b* located corresponding to the top wall 12*a*, and a sidewall 14 connected between the top wall 12*a* and the bottom wall 12*b*. The sidewall 14 has a first face 16*a* and a second face 16*b* which is located opposite to the first face 16*a*. A space between the top wall 12*a*, the bottom wall 12*b* and the first face 16*a* of the sidewall 14 is defined as a slide path 18. The second face 16*b* of the sidewall 14 defines a recessed reinforcement path 20. The reinforcement path (20) is substantially parallel to the slide path (18). Preferably, the reinforcement path 20 is formed substantially along the longitudinal direction of the rail 10 to reinforce the rail 10 by the multiple bent portions of the reinforcement path 20. Besides, a top protrusion 22 extends downward from the second face 16*b* of the sidewall 14 of the rail 10 and reaches into the reinforcement path 20, and a lower protrusion 24 extends upward from the second face 16*b* of the sidewall 14 of the rail 10 and reaches into the reinforcement path 20. Preferably, the top and lower protrusions 22, 24 are located in multiple numbers and located corresponding to each other.

A reinforcement member 26 is movably located in the reinforcement path 20 of the second face 16*b* of the sidewall 14 of the rail 10. An extension support 28 is fixed to the reinforcement member 26. The top and lower protrusions 22, 24 keep the reinforcement member 26 to be movable in the reinforcement path 20 along the longitudinal direction of the rail 10. Furthermore, the extension support 28 comprises a first flange 30*a*, a second flange 30*b* located corresponding to the first flange 30*a*, and a first connection portion 32 connected between the first flange 30*a* and the second flange 30*b*. The first flange 30*a*, the second flange 30*b* and the first connection portion 32 define an arm. The first connection portion 32 of the extension support 28 is connected to the reinforcement member 26 by way of riveting, the first flange 30*a* and the second flange 30*b* hold the top wall 12*a* and the bottom wall 12*b* of the rail 10, so that the reinforcement member 26 and the extension support 28 are slidable relative to the rail 10, and the slide assembly is properly reinforced.

An installation support 34 is movably connected to the extension support 28. The installation support 34 has a first support portion 36*a*, a second support portion 36*b* located corresponding to the first support portion 36*a*, and a second connection portion 38 connected between the first support portion 36*a* and the second support portion 36*b*. Preferably, the second connection portion 38 of the installation support 34 has two separated longitudinal slots 40 and at least two positioning members 42 respectively extend the longitudinal slots 40 and are connected to the extension support 28. By this arrangement, the installation support 34 is movable relative to the extension support 28 and along the longitudinal slots 40 by the positioning members 42. The first support portion 36*a* contacts the first flange 30*a* and the second support portion 36*b* contacts the second flange 30*b*. An installation portion 44 is connected to an end of the installation support 34.

Figure 3:
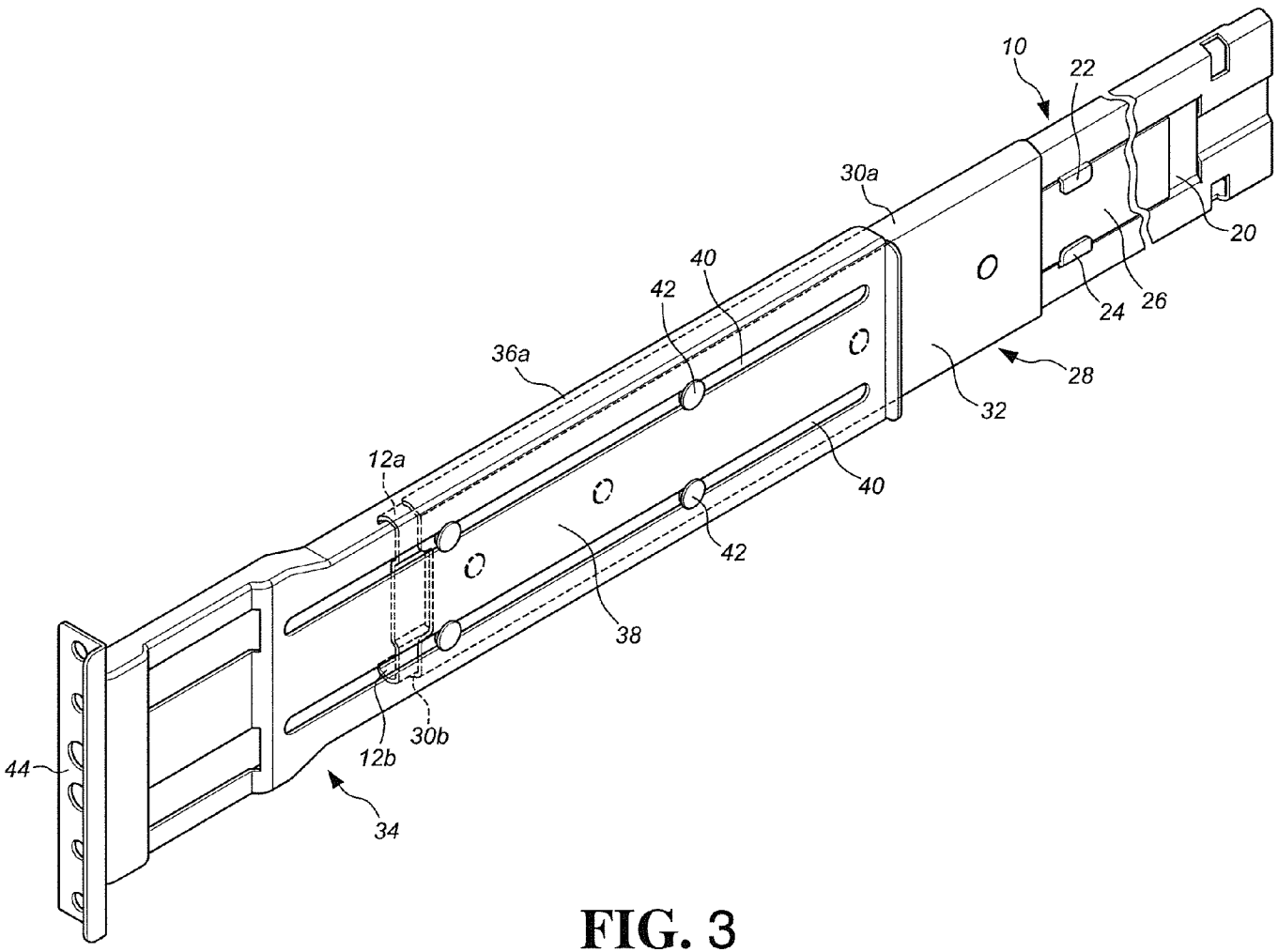
FIG. 3 is a perspective view to show that the reinforcement member, the extension support and the installation support are connected to the rail.
Figure 4:
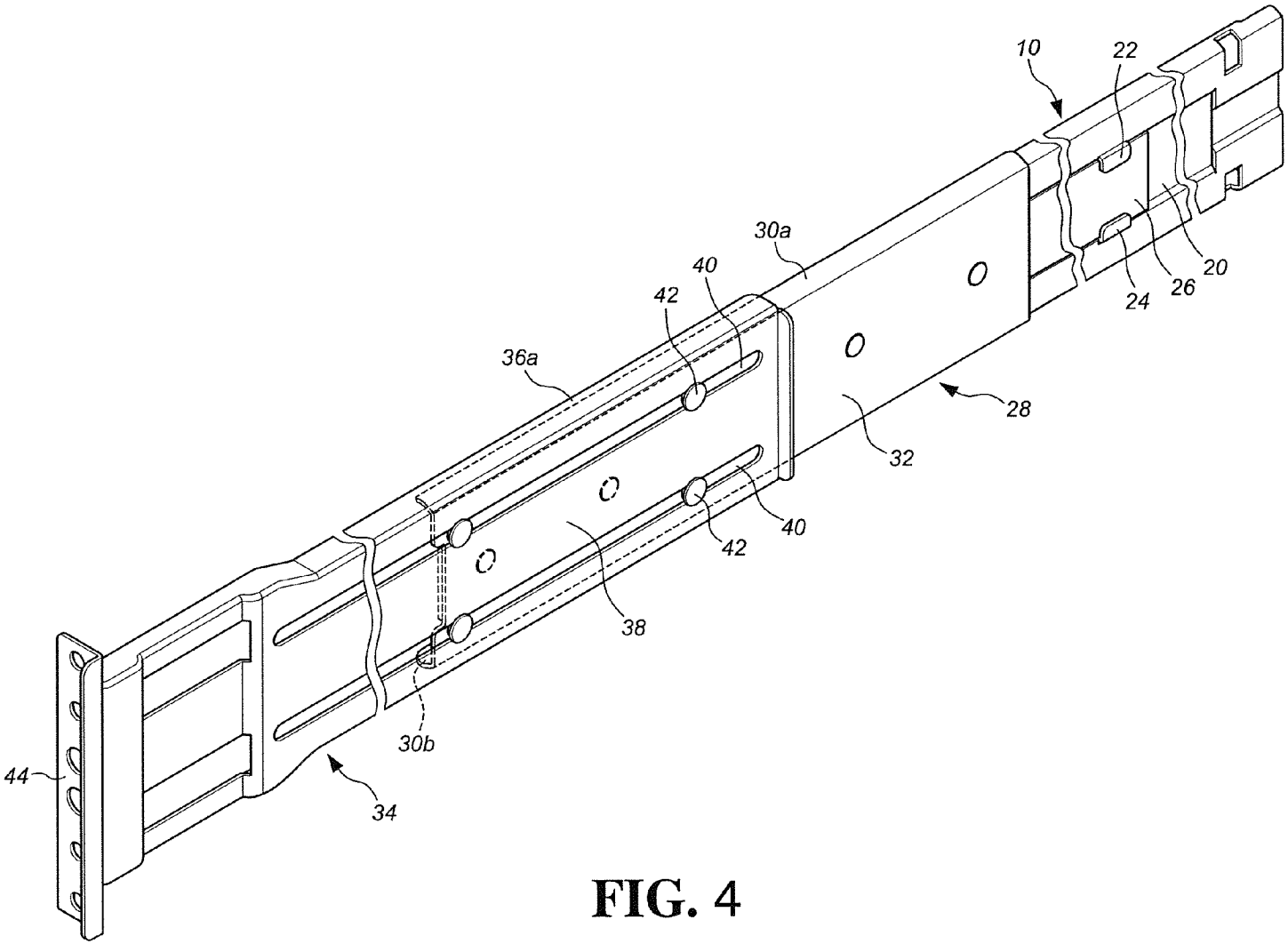
FIG. 4 is a perspective view to show that the reinforcement member, the extension support and the installation support are telescoped relative to the rail.

Referring to FIGS. 3 and 4, when the extension support 28 is moved relative to the rail 10, the reinforcement member 26 is moved along the reinforcement path 20 simultaneously so as to have the first stage of adjustment. Furthermore, the installation support 34 is movable relative to the extension support 28 to have the second stage of adjustment. Therefore, the installation support 34 can be used to the racks of different depths. Besides, the reinforcement member 26 is moved in the reinforcement path 20 of the rail 10 provides the rail 10 with options to reinforce desired sections.

While we have shown and described the embodiment in accordance with the present invention, it should be clear to those skilled in the art that further embodiments may be made without departing from the scope of the present invention.

What is claimed is:

1. A reinforcement and adjustment device comprising:

a rail having a top wall, a bottom wall located corresponding to the top wall, and a sidewall connected between the top wall and the bottom wall, the sidewall having a first face and a second face which is located opposite to the first face, a space between the top wall, the bottom wall and the first face of the sidewall defining a slide path, the second face of the sidewall defining a recessed reinforcement path;

an extension support fixed to the reinforcement member and having a first flange, a second flange located corresponding to the first flange, and a first connection portion connected between the first flange and the second flange, the first flange, the second flange and the first connection portion defining an arm, an inner surface of the first flange and an inner surface of the second flange respectively engaging an outer surface of the top wall and an outer surface of the bottom wall;

a reinforcement member secured to an inner surface of the extension support and extending laterally past an outer edge thereof, the reinforcement member being slidably received in the recessed reinforcement path; and an installation support movably connected to the extension support and an installation portion connected to an end of the installation support.

2. The device as claimed in claim 1, wherein the reinforcement path is substantially parallel to the slide path.

3. The device as claimed in claim 1, wherein a top protrusion extends downward from the second face of the sidewall of the rail and reaches into the reinforcement path, a lower protrusion extends upward from the second face of the sidewall of the rail and reaches into the reinforcement path, the reinforcement member contacts the top and lower protrusions so as to hold a movement of the reinforcement member in the reinforcement path of the rail.

4. The device as claimed in claim 1, wherein the installation support has a first support portion, a second support portion located corresponding to the first support portion, and a second connection portion connected between the first support portion and the second support portion, the first support portion contacts the first flange and the second support portion contacts the second flange.

5. The device as claimed in claim 4, wherein the second connection portion of the installation support has two separated longitudinal slots and at least two positioning members respectively extend into the longitudinal slots and are connected to the extension support.

* * * * *